US005169063A

United States Patent [19]

Miyazaki et al.

[11] Patent Number: 5,169,063

[45] Date of Patent: Dec. 8, 1992

[54] AIR-CONDITIONER HAVING REFRIGERANT HEATER

[75] Inventors: Koichi Miyazaki, Naka; Takashi Kobayashi; Hidetoshi Fukunaga, both of Fuji, all of Japan

[73] Assignee: Kabushiki Kaisha Toshiba, Kawasaki, Japan

[21] Appl. No.: 820,228

[22] Filed: Jan. 14, 1992

[30] Foreign Application Priority Data

Jan. 19, 1991 [JP] Japan ..... 3-4794

[51] Int. Cl.[5] ..... F23N 5/20; F23N 5/00

[52] U.S. Cl. ..... 237/2 B; 165/11.1; 165/12; 165/29; 431/2; 431/6; 431/18; 431/89; 236/94; 62/238.7

[58] Field of Search ..... 165/29, 12, 11.1; 431/2, 6, 13, 18, 89; 236/94, 2 B; 62/238.7

[56] References Cited

U.S. PATENT DOCUMENTS 4,795,088 1/1989 Kobayashi et al. ..... 165/29
4,802,529 2/1989 Sumitani et al. ..... 165/29
4,915,613 4/1990 Landis et al. ..... 431/89
4,999,792 3/1991 Anderson et al. ..... 431/2

FOREIGN PATENT DOCUMENTS 0131621 10/1980 Japan ..... 431/89
0269820 10/1989 Japan ..... 431/2

*Primary Examiner*—John K. Ford
*Attorney, Agent, or Firm*—Foley & Lardner

[57] ABSTRACT

In this air-conditioner, combustion test of a refrigerant heater is conducted through a control valve on the basis of a minimum combustion command signal and a maximum combustion command signal set in advance at a plurality of stages to store values of the minimum combustion command signal and the maximum combustion command signal presenting an optimum combustion state from the above-mentioned command signals, whereby in an actual operation, control of the control valve is carried out by using stored values with respect to the minimum combustion command signal and the maximum combustion command signal.

3 Claims, 4 Drawing Sheets

AIR-CONDITIONER HAVING REFRIGERANT HEATER

FIELD OF THE INVENTION

This invention relates to an air-conditioner having a refrigerant heater for a heating operation.

BACKGROUND ART

Air-conditioners having a refrigerant or coolant heater are an equipment for heating a refrigerant by means of a refrigerant heater to utilize a heat produced thereby as a heat source in heating operation. FIG. 1 shows one example of such air-conditioners. In FIG. 1, at the time of the heating operation, a circulation circuit of refrigerant is formed by a compressor 1, a four port connection valve 2 (switching position of the solid line), an indoor heat exchanger 3, a valve 4, a refrigerant heater 5, and a check valve 6. On the other hand, at the time of the cooling operation, a circulation circuit of refrigerant is formed by the compressor 1, the four port connection valve 2 (switching position of the broken lines), an outdoor heat exchanger 7, a check valve 8, the indoor heat exchanger 3, and a check valve 9. Here, it is assumed that, at the time of the cooling operation, the valve 4 is closed. This invention is directed to a heating operation of an air-conditioner carried out by using the refrigerant heater 5 without use of the outdoor heat exchanger 7.

The refrigerant heater 5 used in the heating operation of an air-conditioner includes therein a fuel combustor or chamber supplied with fuel, e.g., gas through a control valve 10 to heat the refrigerant by heat produced by the combustor. The quantity of heat produced by the refrigerant heater 5 is controlled by adjusting the opening of the control valve 10 by means of a controller 20. Accordingly, the controller 20 adjusts the opening of the control valve 10 so that a room temperature becomes close to a set temperature thus to control a flow rate of the fuel.

Parts constituting the burning or combustion control system for heating refrigerant in such air-conditioners generally have large unevenness in their characteristics. In order to set minimum and maximum combustion quantities to respective predetermined values at the time when air-conditioners have been assembled, it is required to adjust individual control valves 10 at the area or place where the air-conditioners are assembled or installed. Generally, this adjustment includes a structural adjustment of the control valve 10 itself and an adjustment of the controller 20 combined with the control valve 10.

FIG. 2 shows the controller 20 in FIG. 1 in more detail. The controller 20 includes a combustion command signal generation unit 21 in which a plurality of steps of combustion command values corresponding to quantities of heat that the refrigerant heater 5 should produce are set, and a control valve controller 22 for controlling the opening of the control valve 10 on the basis of the combustion command values. At the combustion command signal generation unit 21, variable resistors 23 and 24 as the minimum combustion command adjustment means and the maximum combustion command adjustment means are provided, respectively.

The adjustment of control valve 10 and controller 20 is conventionally carried out as follows. First, the variable resistors 23 and 24 as the minimum combustion command adjustment means and the maximum combustion command adjustment means are provisionally set at intermediate positions, respectively. Thereafter, a minimum combustion command is caused to be sent from the control valve controller 22 to allow the opening of the control valve 10 to be in correspondence with a value corresponding to the minimum command value, thus to carry out a structural adjustment of the control valve 10 so that the combustion state of the refrigerant heater 5 results in the state corresponding to the minimum combustion command In this instance, since a structural fine adjustment of the control valve 10 is difficult, fine adjustment at the minimum combustion command point is carried out jointly by using adjustment of the variable resistor 23. Then, a maximum combustion command is caused to be sent from the control valve controller 22 to allow the opening of the control valve 10 to be in correspondence with a value corresponding to the maximum command value, thus to control the variable resistor 24 so that the combustion state of the refrigerant heater 5 results in a state corresponding to the maximum combustion command. The above-mentioned adjustments relating to the minimum value and the maximum value of a combustion quantity of the refrigerant heater 5 both rely upon delicate manual work by a skilled operator. However, since the combustion state of the refrigerant heater 5 varies to much degree by a small change of a quantity of fuel supplied as well, the above-mentioned adjustment work is generally difficult. Accordingly, in order to carry out the above-mentioned adjustment work, it takes a considerably long time. In addition, for the variable resistors 23 and 24, variable resistors of the multi-rotary type must be used in order to facilitate fine adjustment. This is disadvantageous from an economic point of view.

SUMMARY OF THE INVENTION

An object of this invention is to provide an air-conditioner having a refrigerant heater which facilitates adjustment of the control valve and the controller therefore at the time of assembling and/or at the time of installation, and which can be manufactured at a low cost.

To achieve the above-described object, an air-conditioner of this invention comprises:

a combustion command signal generator including a minimum combustion command generation unit and a maximum combustion command generation unit respectively having a plurality of stages of command values, a first memory for storing values of a minimum combustion command signal and a maximum combustion command signal corresponding to a command value according to an optimum combustion state of the plurality of stages of command values of the minimum combustion command generation unit and the maximum combustion command generation unit in the combustion test of a refrigerant heater, and a control valve controller for carrying out control of a control valve by using values of the minimum combustion command signal and the maximum combustion command signal stored in the first memory.

Furthermore, the present invention provides an air-conditioner including:

a second memory in which fuel pressure set values for every kind of fuels are stored, a fuel kind discriminator for discriminating the kind of fuels, a pressure sensor for sensing pressure of a fuel delivered to the refrigerant heater, a data reader for reading out, from the second memory, a fuel pressure set value corresponding to the kind of the fuel discriminated by the fuel kind discriminator, a valve opening commander for outputting a valve opening command such that a fuel pressure sensed by the pressure sensor is caused to be in correspondence with a pressure set value read out by the data reader, a data writer for writing, into the second memory, valve opening data when the sensed fuel pressure is in correspondence with the pressure set value in the combustion test of the refrigerant heater, and a control valve controller for controlling the control valve on the basis of valve opening data written into the data writer.

In accordance with this invention, in an air-conditioner having a refrigerant gas heater for delivering combustion gas through the control valve to the gas combustor or chamber for heating the refrigerant heater in the refrigerant circuit, there is employed an arrangement in which optimum maximum/minimum openings of the control valve are caused to be stored. An air-conditioner thus constructed can facilitate an initial adjustment work of the control valve when assembling is completed, and economically become advantageous.

EMBODIMENTS OF THE INVENTION

This invention will now be described in more detail with reference to FIGS. 3 and 4.

Figure 1:
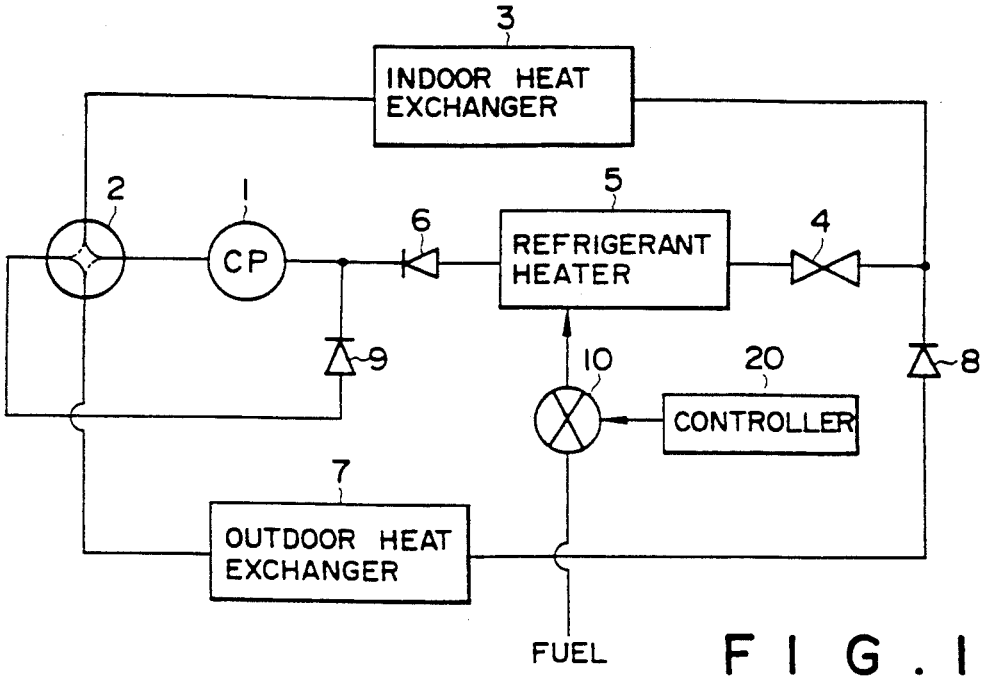
FIG. 1 PRIOR ART
FIG. 1 is a diagram schematically showing the system configuration of an air-conditioner to which this invention is applied.
Figure 2:
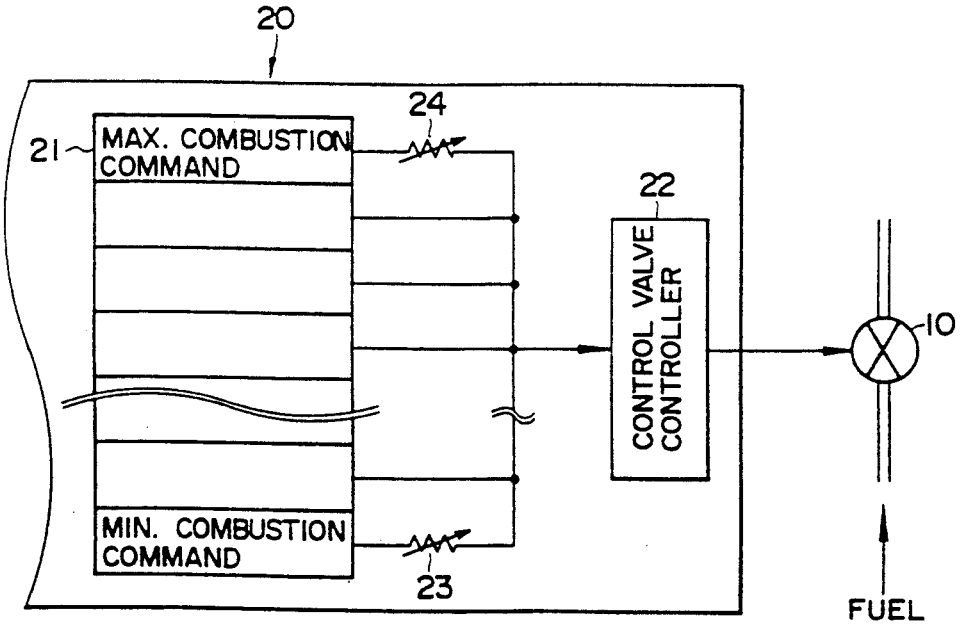
FIG. 2 PRIOR ART
FIG. 2 is a block diagram showing the internal configuration of the controller in the air-conditioner of FIG. 1.
Figure 3:
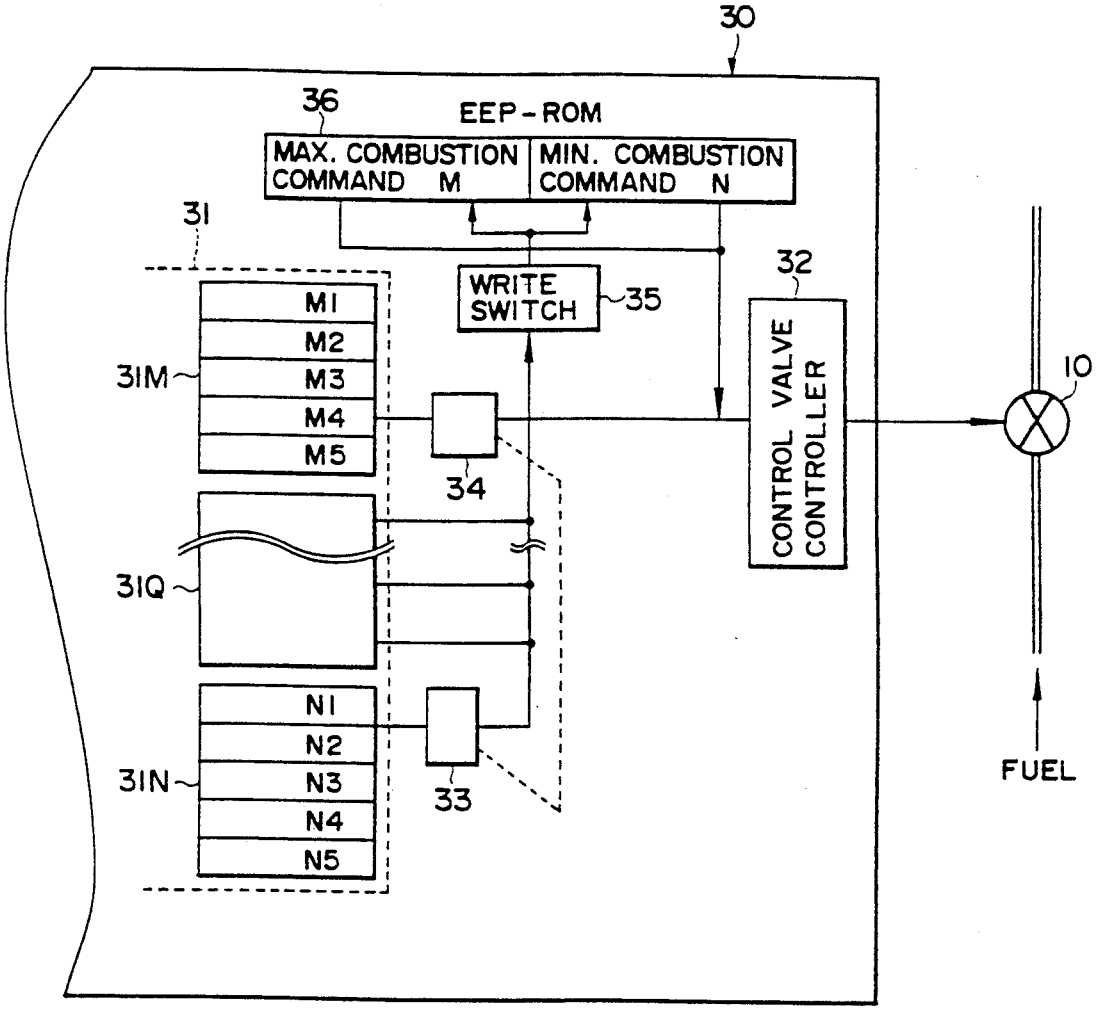
FIG. 3 is a block diagram showing a first embodiment of this invention.
Figure 4:
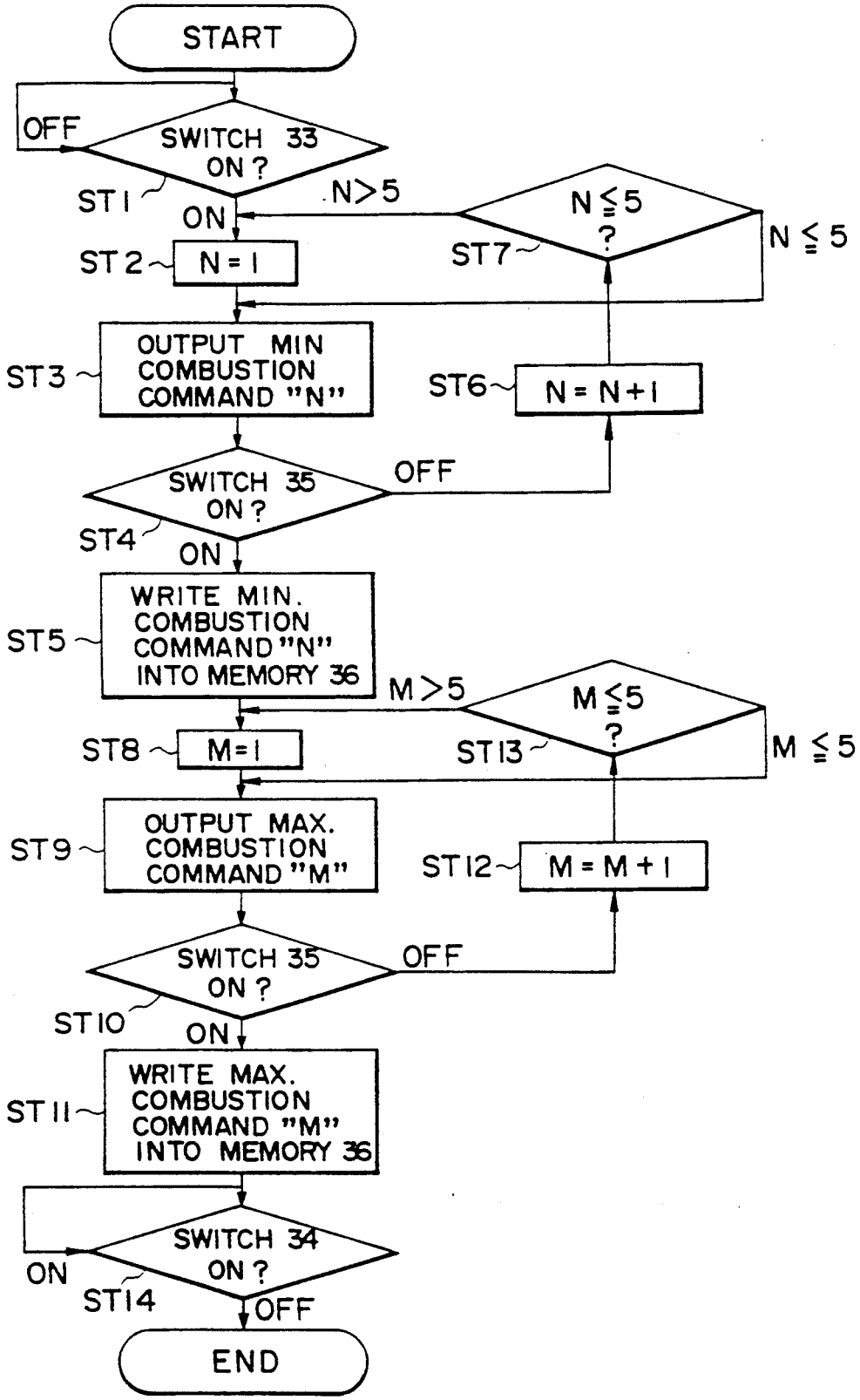
FIG. 4 is a flowchart for explaining the operation of the control unit of FIG. 3.

FIG. 3 is a block diagram showing an embodiment of a controller 30 according to this invention. The controller 30 includes a combustion command signal generation unit 31 and a control valve controller 32. More particularly, the combustion command signal generation unit 31 comprises a minimum combustion command generation unit 31N, an intermediate combustion command generation unit 31Q, and a maximum combustion command generation unit 31M. In more detail, the minimum combustion command generation unit 31N has five stages of minimum combustion sections N1, N2, N3, N4 and N5 for initial adjustment. Similarly, the maximum combustion command generation unit 31M has five stages of maximum combustion command sections M1, M2, M3, M4 and M5. In the minimum combustion command sections N, any one thereof is selected by an adjustment operation through an adjustment switch 33. Similarly, in the maximum combustion command sections M, any one thereof is selected by an adjustment operation through an adjustment switch 34. Then, command values set in the minimum combustion command generation unit 31N and the maximum combustion command generation unit 31M are respectively written as optimum minimum and maximum combustion commands M and N into a memory 36, for example, an EEP-ROM (Electrically Erasable and Programmable ROM) through a write switch 35. The minimum combustion command N and the maximum combustion command M written into the memory 36 are read out by the control valve controller 32.

The operation of the apparatus of FIG. 3 constructed as above will now be described with reference to the flowchart of FIG. 4.

When an operator allows the adjustment switch 33 to be turned ON (step ST1), the minimum combustion command generation unit 31N initially sets the section N1 of the first stage of the minimum combustion command sections (step ST2) to output that command value (step ST3). The control valve controller 32 drives the control valve 10 so that the opening becomes equal to an opening corresponding to the command value of the command section N1. The operator observes the combustion state of the refrigerant heater 5 at this time. As a result, when it is judged that a combustion state corresponding to an optimum value does not yet result, the write switch 35 is caused to remain to be OFF. Then, the minimum combustion command generation unit 31N set the value N to N+1 to slowly increment the value of N to slowly carry out switching in order of the command sections N2, N3 . . . (steps ST4, 6, . . . ). The operator observes the combustion states under the condition of command values of respective command sections to allow the write switch 35 to be turned ON at the time point when it is judged that a combustion state at present is optimum as the combustion state corresponding to a combustion quantity for the minimum combustion command to write an output command value from the minimum combustion command generation unit 31N at that time into the memory 36 on the basis of the recognition that the above output command value is considered to be an optimum minimum combustion command N (steps ST4, 5), and to allow the adjustment switch 33 to be turned OFF.

When any optimum minimum combustion command value is written into the memory 36 in this way, a command value of the command section M1 is then first outputted from the maximum combustion command generation unit 31M (steps ST8, 9). The control valve controller 32 drives the control valve 10 so that the opening becomes equal to an opening corresponding to a command value of the command section M1. The operator observes the combustion state at this time. As a result, when it is judged that a combustion state corresponding to an optimum value does not yet result, the write switch 35 is caused to remain to be OFF. Then, the maximum combustion command generation unit 31M sets the value of M to M+1 to slowly increment the value of M to slowly carry out switching in order of the command sections of M2, M3 . . . (steps ST10, 12) The operator observes the combustion states under the condition of command values of respective command sections to allow the write switch 35 to be turned ON at the time point when it is judged that a combustion quantity at present is optimum as a combustion quantity for the maximum combustion command to write an output command value from the maximum combustion command generation unit 31M at that time into the memory 36 on the basis of the recognition that the above output command value is considered to be an optimum maximum combustion command M (steps ST10, 11). By allowing the adjustment switch 34 to be turned OFF, the adjustment work of the combustion command signal generation unit 31 and the control valve 10 is completed (step ST14).

In the heating operation after such an adjustment work is completed, the control valve controller 32 reads out command values in the minimum and maximum combustion states from the memory 36 to control the opening of the control valve 10 on the basis of the command values thus read out. The above-mentioned work is the work in which it is only required that an operator selects an optimum one from command values set in advance at a plurality of stages while observing the combustion state, but is not the work relying on a delicate manual work as in the prior art. Accordingly, the adjustment work is facilitated, so the working time can be lessened. Further, since a flow rate adjustment screw of the control valve 10 and adjustment variable resistors 23 and 24 of the controller 20, and the like required in the prior art can be omitted, an air-conditioner can be manufactured at a low cost.

It is to be noted that this invention may be carried out in forms as described below.

(1) The combustion command signal generator 31 and the memory 36 may be integrally formed.

(2) The numbers of set stages of minimum combustion command values and maximum combustion command values are not limited to five as in the above-described embodiment. Namely, coarse setting having the number of set stages of four or less or fine setting having the number of set stages of six or more may be made.

(3) Not only the minimum combustion command values and the maximum combustion command values but also the intermediate combustion command values may be stored in the optimum combustion command value memory.

(4) As an optimum combustion command value memory, suitable semiconductor memories except for EEP-ROM may be used.

Meanwhile, in air-conditioners of some kinds, there are instances where a control valve for maintaining a pressure of fuel, e.g., gas supplied at a set value prescribed every kind of gas used is provided. Also with respect to such a control valve, an adjustment work by a delicate manual work similar to the above had to be carried out in the prior art. In view of this, an embodiment for permitting an adjustment work of such a control valve to be easily conducted is shown in FIG. 5.

Figure 5:
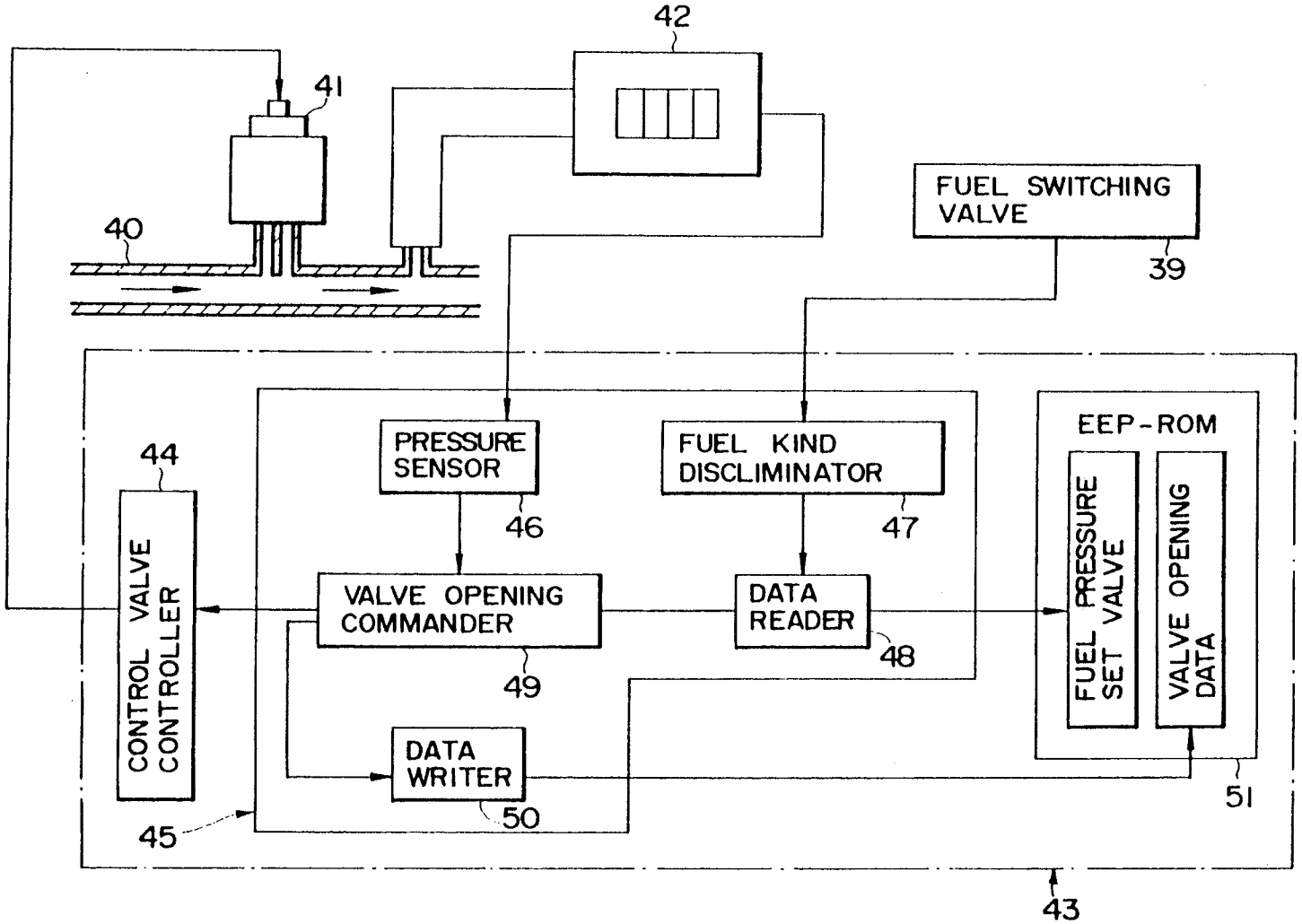
FIG. 5 is a block diagram showing a second embodiment of this invention.

In FIG. 5, a control valve 41 is provided in the middle of a fuel supply path 40. Further, a pressure meter 42 is provided on the downstream side of the control valve 41. A control unit 43 for controlling the control valve 41 comprises a control valve controller 44, a fuel pressure command generator 45, and a data memory 51. More particularly, the fuel pressure command generator 45 comprises a pressure sensor 46 connected to the output terminal of the pressure meter 42, a fuel kind discriminator 47 interlocking with a fuel switching valve 39, a data reader 48, a valve opening commander 49, and a data writer 50. The data memory 51 may be comprised of, e.g., EEP-ROM. The operation of such a control unit 43 will now be described.

Initially, an operator switches the fuel switching valve 39 in correspondence with the kind of a fuel actually used. The pressure sensor 46 senses a fuel pressure on the downstream side of the control valve 41 by an output signal from the pressure meter 42. Further, the fuel kind discriminator 47 discriminates, from a switching position of the fuel switching valve 39, the kind of fuel, e.g., the kind in the case of gas fuel (city gas, non-city gas or liquid fuel), and a quantity of heat produced per unit volume. The data reader 48 reads out, from the data memory 51, a fuel pressure set value prescribed every kind of fuel on the basis of a discrimination signal from the fuel kind discriminator 47 to send out the data thus read out to the valve opening commander 49. The valve opening commander 49 sends out, to the control valve controller 44, a valve opening command signal for allowing a pressure value sensed by the pressure sensor 46 to be in correspondence with a pressure set value read out by the data reader 48. The control valve controller 44 adjusts the opening of the control valve 41 on the basis of the valve opening command signal. At the time point when a pressure sensed by the pressure sensor 46 is in correspondence with a pressure set value read out by the data reader 48, the valve opening commander 49 sends out valve opening data at that time to the data writer 50. The data writer 50 writes this valve opening data into the data memory 51. Thus, an initial adjustment of the control valve 41 is completed.

In the case of carrying out an actual operation after the initial adjustment is completed in this way, the data reader 48 reads out in turn valve opening data obtained by the initial adjustment in place of the fuel pressure set value on the basis of a signal from the fuel kind discriminator 47 to send out this data to the valve opening commander 49.

Such an adjustment work is an adjustment work easy similarly to the work which has been explained in connection with the embodiment of FIG. 3. Also in this case, the time required for adjustment work can be lessened. In addition, since the embodiment shown in FIG. 5 has no necessity of using a variable resistor of the multi-rotary type in the same manner as in the embodiment of FIG. 3, an air-conditioner can be manufactured at a low cost.

What is claimed is:

1. An air-conditioner including a refrigerant heater for heating a refrigerant by combustion of a fuel delivered through a control valve, and an indoor heat exchanger through which the refrigerant heated by said refrigerant heater circulates, said air-conditioner comprising:

a memory for storing fuel pressure set values of every kind of fuels, fuel kind discrimination means for discriminating the kind of fuels, pressure sense means for sensing a pressure of a fuel delivered to said refrigerant heater, data read means for reading out, from said memory, a fuel pressure set value corresponding to the kind of the fuel discriminated by said fuel kind discrimination means, valve opening command means for outputting a valve opening command such that a fuel pressure sensed by said pressure sense means is caused to be in correspondence with a pressure set value read out by said data read means, data write means for writing, into said memory, valve opening data when said fuel pressure sensed by said pressure sense means is in correspondence with said pressure set value in the combustion test of said refrigerant heater, and control valve control means for controlling said control valve on the basis of valve opening data written into said data write means.

2. An air-conditioner as set forth in claim 1, wherein said memory is EEP-ROM.

3. An air-conditioner as set forth in claim 1, wherein said fuel is gas fuel.

* * * * *